US010025240B2

(12) United States Patent
Yamamoto

(10) Patent No.: US 10,025,240 B2
(45) Date of Patent: Jul. 17, 2018

(54) FIXATION APPARATUS AND IMAGE FORMATION APPARATUS

(71) Applicant: Konica Minolta, Inc., Chiyoda-ku, Tokyo (JP)

(72) Inventor: Naoki Yamamoto, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/348,429

(22) Filed: Nov. 10, 2016

(65) Prior Publication Data

US 2017/0139358 A1 May 18, 2017

(30) Foreign Application Priority Data

Nov. 13, 2015 (JP) ..... 2015-223023

(51) Int. Cl.
*G03G 15/20* (2006.01)

(52) U.S. Cl.
CPC ..... *G03G 15/2053* (2013.01); *G03G 15/206* (2013.01); *G03G 2215/2009* (2013.01); *G03G 2215/2035* (2013.01); *G03G 2221/1657* (2013.01)

(58) Field of Classification Search
CPC ..... G03G 15/2053; G03G 15/206; G03G 2215/2009; G03G 2215/2035; G03G 2221/1657
See application file for complete search history.

(56) References Cited

U.S. PATENT DOCUMENTS

2015/0253717 A1 9/2015 Sasaki

FOREIGN PATENT DOCUMENTS

| | | | |
|---|---|---|---|
| JP | H07129004 | A | 5/1995 |
| JP | 2009086105 | A | 4/2009 |
| JP | 2009216799 | A | 9/2009 |
| JP | 2010217457 | A | 9/2010 |
| JP | 2014197076 | A | 10/2014 |
| JP | 2015075659 | A | 4/2015 |
| JP | 2015099185 | A | 5/2015 |

OTHER PUBLICATIONS

Extended European Search Report corresponding to Application No. 16191253.0-1568; dated Mar. 23, 2017.
Notice of Grounds of Rejection for corresponding JP Application No. 2015-223023; dated Sep. 26, 2017.
Final Decision for Rejection for corresponding JP Application No. 2015-223023; dated Jan. 16, 2018.

*Primary Examiner* — Hoang Ngo
(74) *Attorney, Agent, or Firm* — Cantor Colburn LLP

(57) ABSTRACT

A fixation apparatus includes a first belt without end, a second belt without end which is in contact with an outer circumferential surface of the first belt, a pressurization member which is provided inside the first belt and pressurizes a portion of contact between the first belt and the second belt toward the second belt, a drive roller which is provided inside the second belt along the portion of contact and rotationally drives the second belt, and a heating unit which heats at least one of the first belt and the second belt and provides heat to a transfer target medium passing through the portion of contact. The drive roller is in contact with both of the first belt and the second belt.

14 Claims, 8 Drawing Sheets

FIXATION APPARATUS AND IMAGE FORMATION APPARATUS

CROSS REFERENCE TO RELATED APPLICATIONS

This application is based on Japanese Patent Application No. 2015-223023 filed with the Japan Patent Office on Nov. 13, 2015, the entire content of which is hereby incorporated by reference.

BACKGROUND OF THE INVENTION

Field of the Invention

The present disclosure relates to an image formation apparatus and particularly to a structure of a fixation apparatus included in the image formation apparatus.

Description of the Related Art

An image formation apparatus of an electrophotography type has widely been used. The image formation apparatus of the electrophotography type performs as printing steps, the steps of transferring a toner image in accordance with an input image to paper and fixing the transferred toner image onto paper. The toner image is fixed by a fixation apparatus mounted on the image formation apparatus.

Some fixation apparatuses include two belts without end (hereinafter also referred to as an "endless belt"). Hereinafter, one of the two endless belts is also referred to as a first endless belt and the other is also referred to as a second endless belt. A pressurization member is provided inside the first endless belt. The pressurization member is fixed inside the first endless belt, and the first endless belt and the second endless belt are brought in contact with each other by pressurizing the first endless belt toward the second endless belt.

In the step of fixing a toner image, the fixation apparatus rotates at least one of the first endless belt and the second endless belt while the belts are heated, and pressurizes and heats paper which passes between the first endless belt and the second endless belt. The toner image on paper is thus fixed onto the paper. Since the endless belt is in a form of a belt, an area of a portion of contact between the first endless belt and the second endless belt (hereinafter also referred to as a "nip portion") increases and heat is efficiently transferred to paper at the nip portion. Power consumption is thus suppressed.

In connection with a fixation apparatus including an endless belt, Japanese Laid-Open Patent Publication No. 2014-197076 discloses a fixing device "with a simple structure that prevents a failure of sheet conveyance at the sheet entry position." Japanese Laid-Open Patent Publication No. 2010-217457 discloses a fixing device "which solves problems of misalignment of an image and displacement of a belt to the left or right due to a difference in peripheral speed."

The fixing device disclosed in Japanese Laid-Open Patent Publication No. 2014-197076 includes a pressure belt and a fusing belt as endless belts. A drive roller for rotationally driving the pressure belt is provided inside the pressure belt. As the drive roller rotationally drives the pressure belt, driving force is transmitted to the fusing belt in contact with the pressure belt. Since the fusing belt is not in direct contact with the drive roller, a difference in driving force is caused between the fusing belt and the pressure belt. Consequently, a difference in peripheral speed is caused between the fusing belt and the pressure belt, which leads to image misalignment or paper slippage.

The fixing device disclosed in Japanese Laid-Open Patent Publication No. 2010-217457 includes a first belt and a second belt as endless belts. A recess portion and a projection portion are provided along a direction of rotation at opposing ends of the first belt and the second belt, the recess portion and the projection portion being constructed to fit into each other during rotation. The fixing device thus suppresses a difference in peripheral speed between the first belt and the second belt. In order to realize this, however, projections and recesses should be provided at the opposing ends of the first belt and the second belt, and cost for manufacturing the fixing device increases. Since stress is concentrated to the projection and recess portions, durability is low.

Therefore, a fixation apparatus capable of suppressing a difference in peripheral speed between at least two endless belts with a construction more simplified than in a conventional example is desired.

SUMMARY OF THE INVENTION

To achieve at least one of the abovementioned objects, a fixation apparatus reflecting one aspect of the present invention comprises a first belt without end, a second belt without end which is in contact with an outer circumferential surface of the first belt, a pressurization member which is provided inside the first belt and pressurizes a portion of contact between the first belt and the second belt toward the second belt, a drive roller which is provided inside the second belt along the portion of contact and rotationally drives the second belt, and a heating unit which heats at least one of the first belt and the second belt and provides heat to the transfer target medium passing through the portion of contact. The drive roller is in contact with both of the first belt and the second belt.

Preferably, at least one end of opposing ends of the drive roller protrudes from the second belt in an axial direction of the drive roller. A protruding portion of the drive roller from the second belt is in contact with the first belt.

Preferably, the protruding portion of the drive roller is in contact with the outer circumferential surface of the first belt. A non-protruding portion other than the protruding portion of the drive roller is in contact with an inner circumferential surface of the second belt.

Preferably, a width of the drive roller in the axial direction is smaller than a width of the first belt in the axial direction, smaller than a width of the pressurization member in the axial direction, and greater than a width of the second belt in the axial direction.

Preferably, a distance from one end of the second belt in the axial direction to one end of the drive roller in the axial direction is equal to a distance from the other end of the second belt to the other end of the drive roller. A distance from one end of the pressurization member in the axial direction to one end of the drive roller in the axial direction is equal to a distance from the other end of the pressurization member to the other end of the drive roller. A distance from one end of the first belt in the axial direction to one end of the drive roller in the axial direction is equal to a distance from the other end of the first belt to the other end of the drive roller.

Preferably, a width of the pressurization member in the axial direction is smaller than a width of the first belt in the axial direction. The pressurization member is arranged inside the first belt so as not to protrude from opposing ends of the first belt in the axial direction.

Preferably, a pressure applied to a portion of contact between the first belt and the drive roller is higher than a pressure applied to the portion of contact between the first belt and the second belt.

Preferably, a diameter of the drive roller in a portion of contact between the drive roller and the second belt is smaller than a diameter of the drive roller in a portion of contact between the drive roller and the first belt.

According to another aspect, an image formation apparatus including the fixation apparatus is provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
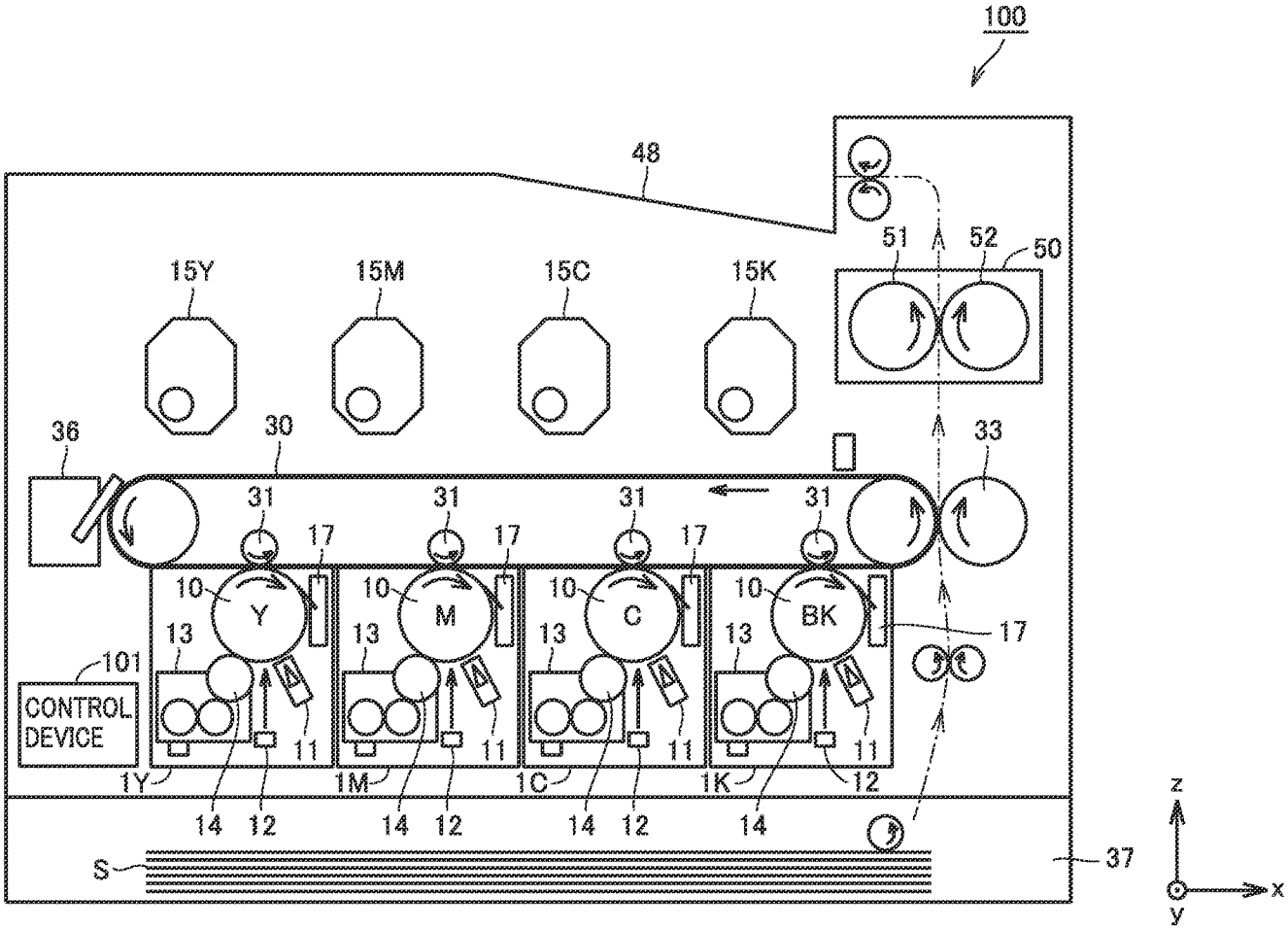
FIG. 1 is a diagram showing one example of an apparatus construction of an image formation apparatus according to an embodiment.

Each embodiment according to the present invention will be described hereinafter with reference to the drawings. In the description below, the same elements and components have the same reference characters allotted. Their label and function are also identical. Therefore, detailed description thereof will not be repeated. Each embodiment and each modification described below may selectively be combined as appropriate.

[Internal Structure of Image Formation Apparatus 100]

An image formation apparatus 100 according to an embodiment will be described with reference to FIG. 1. FIG. 1 is a diagram showing one example of an apparatus construction of image formation apparatus 100.

FIG. 1 shows image formation apparatus 100 as a color printer. Though image formation apparatus 100 as a color printer is described below, image formation apparatus 100 is not limited to a color printer. For example, image formation apparatus 100 may be a monochrome printer, a facsimile, or a multi-functional peripheral (MFP) which is combination of a monochrome printer, a color printer, and a facsimile.

Image formation apparatus 100 includes image formation units 1Y, 1M, 1C, and 1K, an intermediate transfer belt 30, a primary transfer roller 31, a secondary transfer roller 33, a cassette 37, a fixation apparatus 50, a cleaning portion 36, and a control device 101.

Image formation unit 1Y forms a toner image of yellow (Y) upon receiving supply of toner from a toner bottle 15Y. Image formation unit 1M forms a toner image of magenta (M) upon receiving supply of toner from a toner bottle 15M. Image formation unit 1C forms a toner image of cyan (C) upon receiving supply of toner from a toner bottle 15C. Image formation unit 1K forms a toner image of black (BK) upon receiving supply of toner from a toner bottle 15K.

Image formation units 1Y, 1M, 1C, and 1K are arranged sequentially along a direction of rotation of intermediate transfer belt 30. Each of image formation units 1Y, 1M, 1C, and 1K includes a photoconductor 10, a charger 11, an exposure portion 12, a developer 13, and a cleaning portion 17.

Photoconductor 10 is an image carrier which carries a toner image. By way of example, a photoconductor drum on which surface a photoconductive layer is formed is adopted as photoconductor 10.

Charger 11 evenly charges a surface of photoconductor 10. Exposure portion 12 irradiates photoconductor 10 with laser in response to a control signal from control device 101 and exposes the surface of photoconductor 10 in accordance with a designated image pattern. An electrostatic latent image in accordance with an input image is thus formed on photoconductor 10.

Developer 13 applies a development bias to a development roller 14 while it rotates development roller 14, to thereby attach toner onto a surface of development roller 14. The toner image is thus transferred from development roller 14 to photoconductor 10 and a toner image in accordance with the electrostatic latent image is developed on the surface of photoconductor 10.

Photoconductor 10 and intermediate transfer belt 30 are in contact with each other at a portion where primary transfer roller 31 is provided. A transfer bias applied to the portion of contact transfers the toner image developed on photoconductor 10 to intermediate transfer belt 30. Here, the toner image of yellow (Y), the toner image of magenta (M), the toner image of cyan (C), and the toner image of black (BK) are successively layered and transferred to intermediate transfer belt 30. The color toner image is thus formed on intermediate transfer belt 30.

Cleaning portion 17 includes a cleaning blade. The cleaning blade is pressed against photoconductor 10 and recovers toner which remains on the surface of photoconductor 10 after transfer of the toner image.

Paper S (transfer target medium) is set in cassette 37. Paper S is sent from cassette 37 to secondary transfer roller 33 one by one. Secondary transfer roller 33 transfers to paper S, a toner image once transferred to intermediate transfer belt 30. By synchronizing timing of feed and transportation of paper S with a position of the toner image on intermediate transfer belt 30, the toner image is transferred to an appropriate position on paper S. Thereafter, paper S is sent to fixation apparatus 50.

Fixation apparatus 50 includes an endless belt 51 and an endless belt 52. Fixation apparatus 50 passes paper S between endless belt 51 and endless belt 52 and pressurizes and heats paper S. The toner image transferred onto paper S is thus fixed onto paper S. Thereafter, paper S is ejected onto a tray 48.

Cleaning portion 36 includes a cleaning blade. The cleaning blade is pressed against intermediate transfer belt 30 and recovers toner which remains on intermediate transfer belt 30 after transfer of the toner image. The recovered toner is transported by a transportation screw (not shown) and stored in a waste toner container (not shown).

Control device 101 controls, for example, a motor (not shown) for rotationally driving at least one of endless belts 51 and 52 of fixation apparatus 50 and controls a transportation speed of paper S in fixation apparatus 50.

[Internal Structure of Fixation Apparatus 50]

Figure 2:
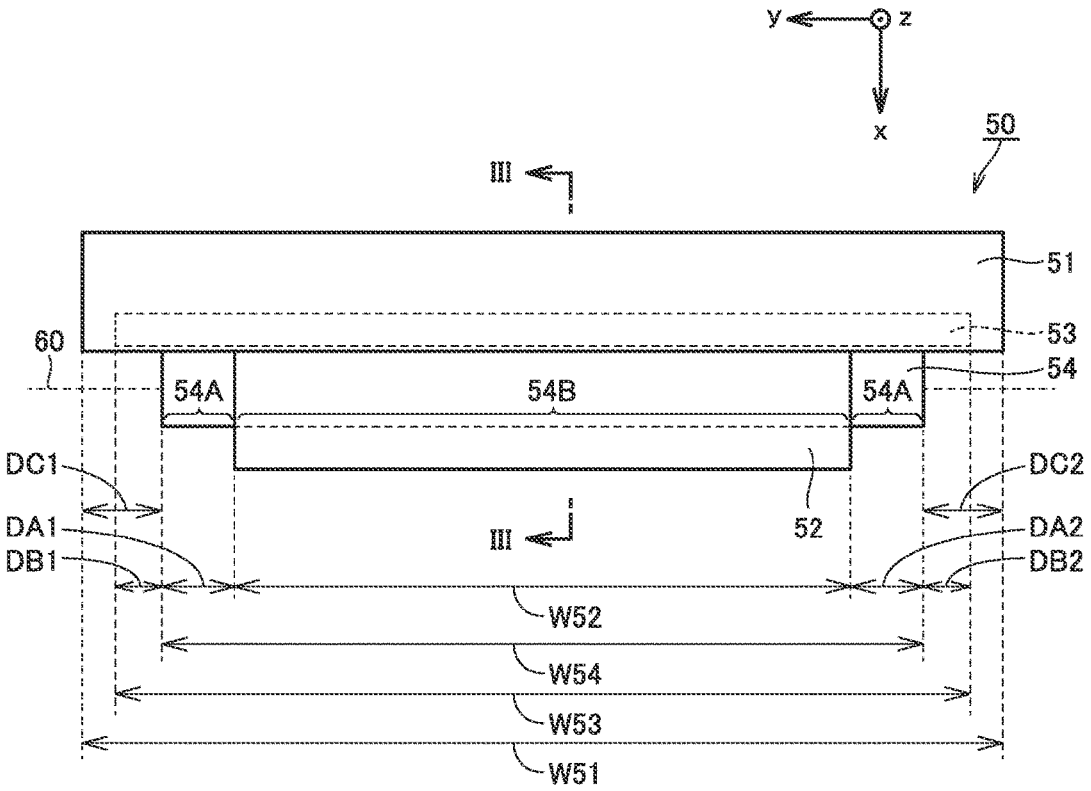
FIG. 2 is a diagram showing one example of an internal structure of a fixation apparatus according to the embodiment.
Figure 3:
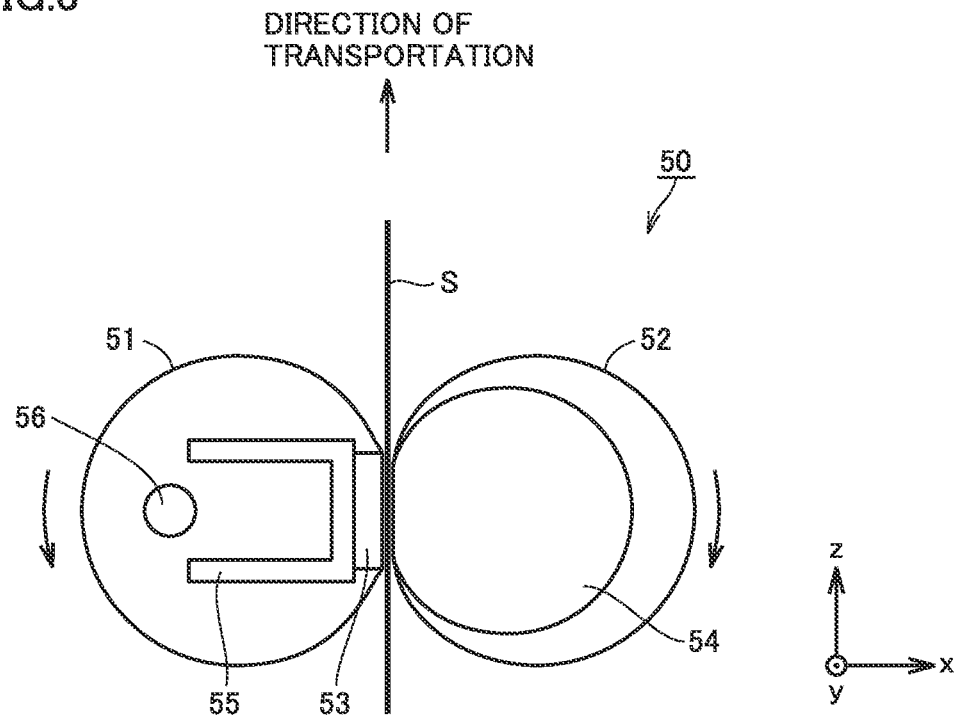
FIG. 3 is a cross-sectional view of the fixation apparatus along the line III-III in FIG. 2.

An internal structure of fixation apparatus 50 will be described with reference to FIGS. 2 and 3. FIG. 2 is a diagram showing one example of the internal structure of fixation apparatus 50. FIG. 3 is a cross-sectional view of fixation apparatus 50 along the line III-III in FIG. 2.

As shown in FIGS. 2 and 3, fixation apparatus 50 includes endless belt 51 (first endless belt), endless belt 52 (second endless belt), a pressurization member 53, a drive roller 54, a support member 55, and a heater lamp 56 (heating unit).

Endless belts 51 and 52 are supported by a support portion (not shown) fixed, for example, to a housing of fixation apparatus 50, and constructed to be rotatable. Endless belt 51 and endless belt 52 are in contact with each other and rotate in coordination.

Pressurization member 53 is provided inside endless belt 51. Pressurization member 53 is fixed along a portion of contact between endless belt 51 and endless belt 52 (hereinafter also referred to as a "nip portion"), for example, by support member 55 fixed to the housing of fixation apparatus 50. Pressurization member 53 is fixed while the nip portion between endless belts 51 and 52 is pressurized toward endless belt 51. A size of the nip portion between endless belts 51 and 52 thus increases.

Heater lamp 56 is provided inside endless belt 51. Heater lamp 56 heats endless belt 51. Heater lamp 56 thus heats paper S which passes between endless belt 51 and endless belt 52. Consequently, a toner image formed on paper S is molten and fixed onto paper S. Heater lamp 56 may be provided inside endless belt 52, instead of inside endless belt 51. Heater lamp 56 heats at least one of endless belt 51 and endless belt 52.

Drive roller 54 for driving endless belt 52 is provided inside endless belt 52. By way of example, a motor (not shown) is connected to drive roller 54 so that image formation apparatus 100 rotationally drives drive roller 54 under pulse width modulation (PWM) control of the motor. Drive roller 54 is provided along the portion of contact between endless belts 51 and 52 and is in contact with both of endless belt 51 and endless belt 52. At least a part of drive roller 54 is in contact with endless belt 51 and a remaining portion of drive roller 54 is in contact with endless belt 52.

More specifically, at least one end of opposing ends of drive roller 54 protrudes from endless belt 52 in a direction of a rotation axis of drive roller 54. A protruding portion 54A of drive roller 54 is in contact with endless belt 51. Preferably, protruding portion 54A of drive roller 54 is in contact with an outer circumferential surface of endless belt 51, and a non-protruding portion 54B other than protruding portion 54A of drive roller 54 is in contact with an inner circumferential surface of endless belt 52. The outer circumferential surface of drive roller 54 is in contact with both of the outer circumferential surface of endless belt 51 and the inner circumferential surface of endless belt 52.

Driving force of drive roller 54 is thus directly transmitted not only to endless belt 52 but also to endless belt 51. As driving force is directly provided from one drive roller 54 to endless belts 51 and 52, endless belt 51 and endless belt 52 are the same or substantially the same in peripheral speed. Consequently, a difference in peripheral speed between endless belts 51 and 52 is suppressed so that image misalignment or slippage of paper S is suppressed. Since it is not necessary to provide a new feature for suppressing a difference in peripheral speed between endless belts 51 and 52, cost for manufacturing fixation apparatus 50 is suppressed.

Preferably, a width W54 of drive roller 54 in an axial direction 60 is smaller than a width W51 of endless belt 51 in axial direction 60. Axial direction 60 here corresponds to a direction of the rotation axis (a direction of a central axis) of drive roller 54 or a longitudinal direction of drive roller 54. Width W54 of drive roller 54 is smaller than a width W53 of pressurization member 53 in axial direction 60. Width W54 of drive roller 54 is greater than a width W52 of endless belt 52 in axial direction 60. Widths W51 to W54 exhibit relation in an expression (1) below. An advantage by satisfying this relation will be described in "comparative examples" which will be described later.

$$\text{Width W52} < \text{Width W54} < \text{Widths W51 and W53} \quad (1)$$

Preferably, endless belts 51 and 52, pressurization member 53, and drive roller 54 are arranged in axial direction 60 such that intermediate points thereof are aligned. A distance DA1 from one end of endless belt 52 in axial direction 60 to one end of drive roller 54 in axial direction 60 is equal to a distance DA2 from the other end of endless belt 52 to the other end of drive roller 54. A distance DB1 from one end of pressurization member 53 in axial direction 60 to one end of drive roller 54 in axial direction 60 is equal to a distance DB2 from the other end of pressurization member 53 to the other end of drive roller 54. A distance DC1 from one end of endless belt 51 in axial direction 60 to one end of drive roller 54 in axial direction 60 is equal to a distance DC2 from the other end of endless belt 51 to the other end of drive roller 54. Thus, driving force or a pressure of drive roller 54 is applied symmetrically to the portion of contact between endless belts 51 and 52, and endless belts 51 and 52 are prevented from obliquely moving.

Distance DA1 and distance DA2 do not have to be strictly the same, and they should only be substantially the same. Similarly, distance DB1 and distance DB2 do not have to be strictly the same, and they should only be substantially the same. Similarly, distance DC1 and distance DC2 do not have to be strictly the same, and they should only be substantially the same.

[First Comparative Example]

Figure 4:
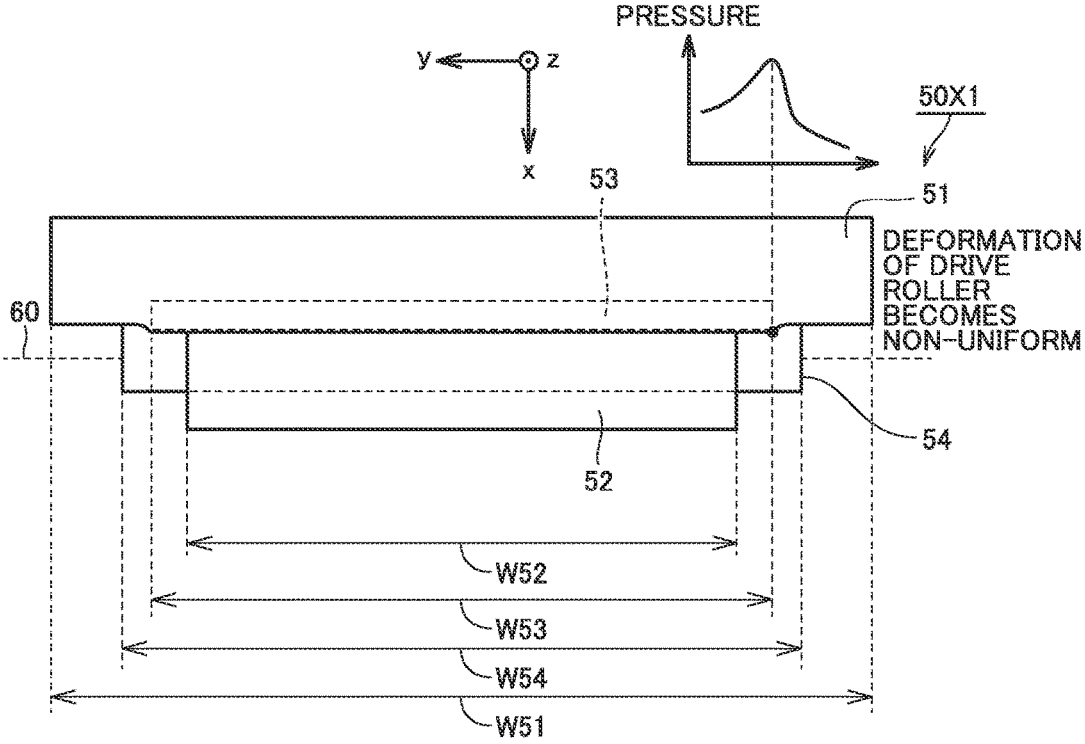
FIG. 4 is a diagram showing an internal structure of a fixation apparatus according to a first comparative example

An advantage of fixation apparatus 50 according to the embodiment will be described with reference to FIGS. 2 and 4. FIG. 4 is a diagram showing an internal structure of a fixation apparatus 50X1 according to a first comparative example.

As described above, in fixation apparatus 50 according to the embodiment, width W54 of drive roller 54 is smaller than width W53 of pressurization member 53. In contrast, in fixation apparatus 50X1 according to the first comparative example, width W54 of drive roller 54 is greater than width W53 of pressurization member 53.

With such a construction, as shown in FIG. 4, a pressure is concentrated to an end portion of pressurization member 53 and a shape of the surface of drive roller 54 becomes non-uniform. Therefore, fixation apparatus 50X1 may not be able to effectively suppress a difference in peripheral speed between endless belts 51 and 52.

In fixation apparatus 50 according to the embodiment, since width W53 of pressurization member 53 is greater than width W54 of drive roller 54, force is evenly applied from pressurization member 53 to drive roller 54 and concentration of stress can be suppressed. Consequently, fixation apparatus 50 can effectively suppress a difference in peripheral speed between endless belts 51 and 52.

[Second Comparative Example]

Figure 5:
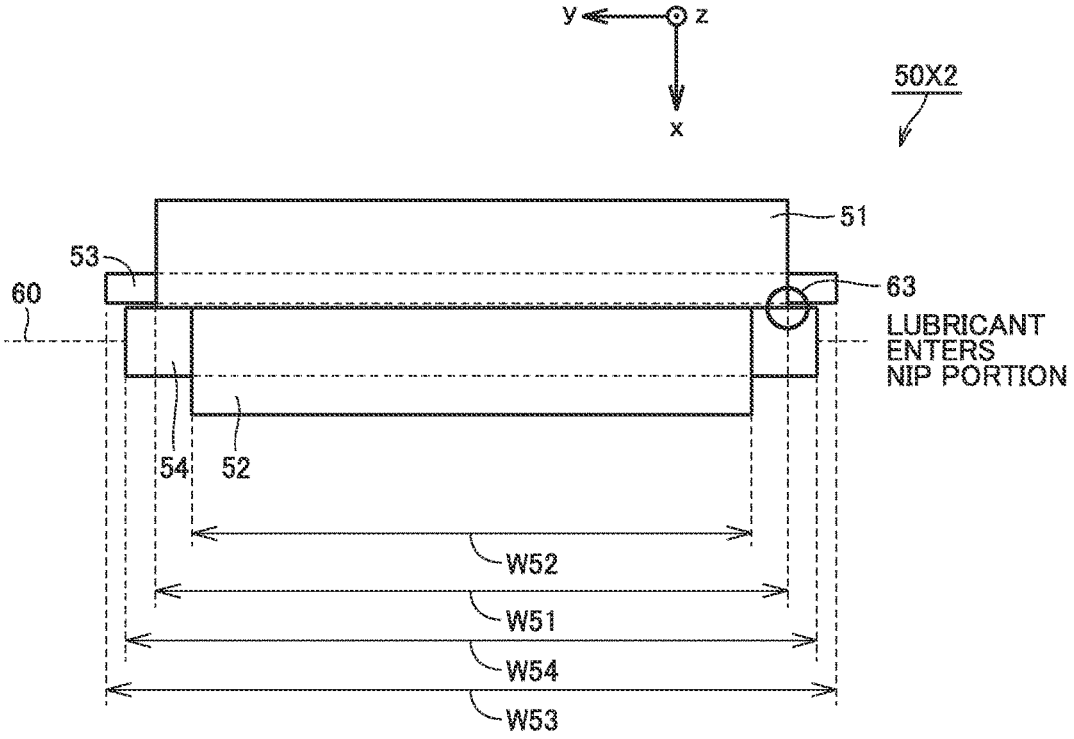
FIG. 5 is a diagram showing an internal structure of a fixation apparatus according to a second comparative example.

An advantage of fixation apparatus 50 according to the embodiment will further be described with reference to FIGS. 2 and 5. FIG. 5 is a diagram showing an internal structure of a fixation apparatus 50X2 according to a second comparative example.

As described above, in fixation apparatus 50 according to the embodiment, width W51 of endless belt 51 is greater than width W53 of pressurization member 53 and width W54 of drive roller 54. In contrast, in fixation apparatus 50X2 according to the second comparative example, width W51 of endless belt 51 is smaller than width W53 of pressurization member 53 and width W54 of drive roller 54.

A lubricant may be applied to pressurization member 53 in order to lessen sliding resistance between endless belt 51 and pressurization member 53. When width W51 is smaller than width W54 as in fixation apparatus 50X2, the lubricant may seep out of opposing ends of endless belt 51. Consequently, the lubricant may enter the nip portion between endless belt 51 and drive roller 54 or the nip portion between endless belts 51 and 52 (see a focus area 63), which may lower a friction coefficient at the nip portion and cause image misalignment or paper slippage.

In fixation apparatus 50 according to the embodiment, width W51 of endless belt 51 is greater than width W53 of pressurization member 53 and width W54 of drive roller 54. Therefore, the lubricant does not enter the nip portion between endless belt 51 and drive roller 54 or the nip portion between endless belts 51 and 52. Thus, fixation apparatus 50 can prevent image misalignment or paper slippage.

[Third Comparative Example]

Figure 6:
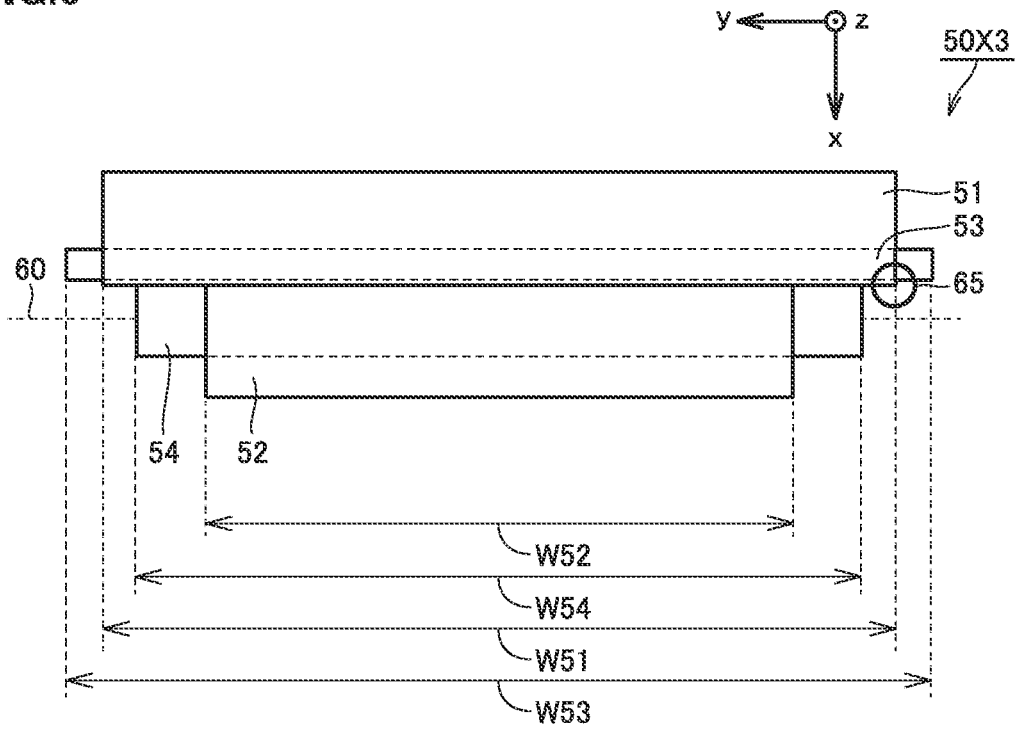
FIG. 6 is a diagram showing an internal structure of a fixation apparatus according to a third comparative example.

An advantage of fixation apparatus 50 according to the embodiment will further be described with reference to FIGS. 2 and 6. FIG. 6 is a diagram showing an internal structure of a fixation apparatus 50X3 according to a third comparative example.

As shown in FIG. 2, in fixation apparatus 50 according to the embodiment, width W53 of pressurization member 53 in axial direction 60 is smaller than width W51 of endless belt 51 in axial direction 60. Widths W51 and W53 exhibit relation in an expression (2) below. Pressurization member 53 is arranged inside endless belt 51 and arranged not to protrude from opposing ends of endless belt 51 in axial direction 60. Pressurization member 53 is accommodated in endless belt 51.

$$\text{Width W53} < \text{Width W51} \quad (2)$$

In contrast, in fixation apparatus 50X3 according to the third comparative example, width W53 of pressurization member 53 in axial direction 60 is greater than width W51 of endless belt 51 in axial direction 60. Pressurization member 53 protrudes from opposing ends of endless belt 51.

A lubricant may be applied to pressurization member 53 in order to lessen sliding resistance between endless belt 51 and pressurization member 53. When width W53 is greater than width W51 as in fixation apparatus 50X3, the lubricant may seep out of the opposing ends of endless belt 51 (see a focused area 65). Therefore, the lubricant may enter the nip portion between endless belt 51 and drive roller 54 or the nip portion between endless belts 51 and 52, which may lower a friction coefficient at the nip portion and cause image misalignment or paper slippage.

In fixation apparatus 50 according to the embodiment, width W53 of pressurization member 53 is smaller than width W51 of endless belt 51 and pressurization member 53 is accommodated in endless belt 51. The lubricant applied to pressurization member 53 is thus prevented from seeping out of the opposing ends of endless belt 51 and image misalignment or paper slippage is prevented.

[Fixation Apparatus 50 According to First Modification]

Fixation apparatus 50 according to a first modification will be described with reference again to FIG. 2.

In the description above, a pressure applied to the portion of contact between endless belt 51 and endless belt 52 and a pressure applied to the portion of contact between endless belt 51 and drive roller 54 are not particularly mentioned. In fixation apparatus 50 according to the first modification, a pressure applied to the portion of contact between endless belt 51 and drive roller 54 is higher than a pressure applied to the portion of contact between endless belt 51 and endless belt 52. A pressure distribution in the portion of contact in drive roller 54 is higher at an end portion than in a central portion. Thus, even when a width of contact between endless belt 51 and drive roller 54 is small, drive roller 54 can transmit sufficient driving force to endless belt 51.

In one aspect, by differing an outer diameter of drive roller 54 depending on a position in axial direction 60, a pressure applied from drive roller 54 to endless belt 51 is raised. More specifically, an outer diameter of drive roller 54 in the portion of contact between endless belt 51 and drive roller 54 is made larger than an outer diameter of drive roller 54 in the portion of contact between endless belt 51 and endless belt 52. A pressure applied to the portion of contact between endless belt 51 and drive roller 54 is thus higher than a pressure applied to the portion of contact between endless belt 51 and endless belt 52.

In another aspect, by differing an outer diameter of endless belt 51 depending on a position in axial direction 60, a pressure applied from drive roller 54 to endless belt 51 is raised. More specifically, an outer diameter of endless belt 51 in the portion of contact between endless belt 51 and drive roller 54 is made larger than an outer diameter of endless belt 51 in the portion of contact between endless belt 51 and endless belt 52. A pressure applied to the portion of contact between endless belt 51 and drive roller 54 is thus higher than a pressure applied to the portion of contact between endless belt 51 and endless belt 52.

[Fixation Apparatus 50 According to Second Modification]

Figure 7:
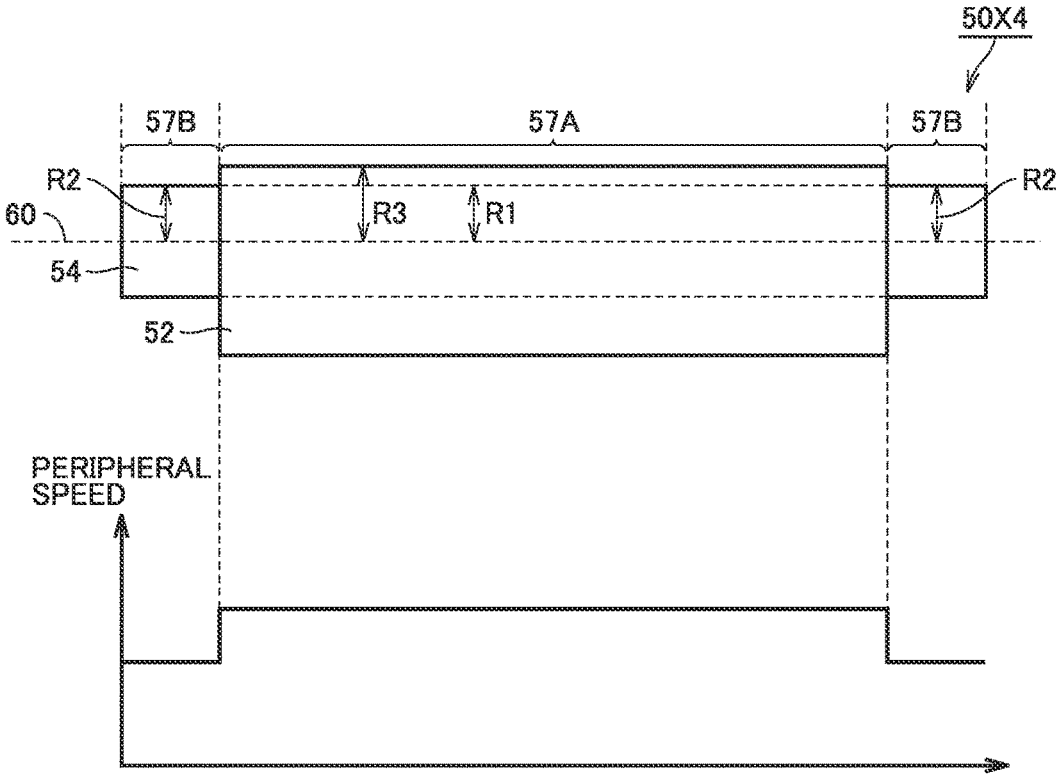
FIG. 7 is a diagram showing an endless belt and a drive roller in a fixation apparatus according to a fourth comparative example.
Figure 8:
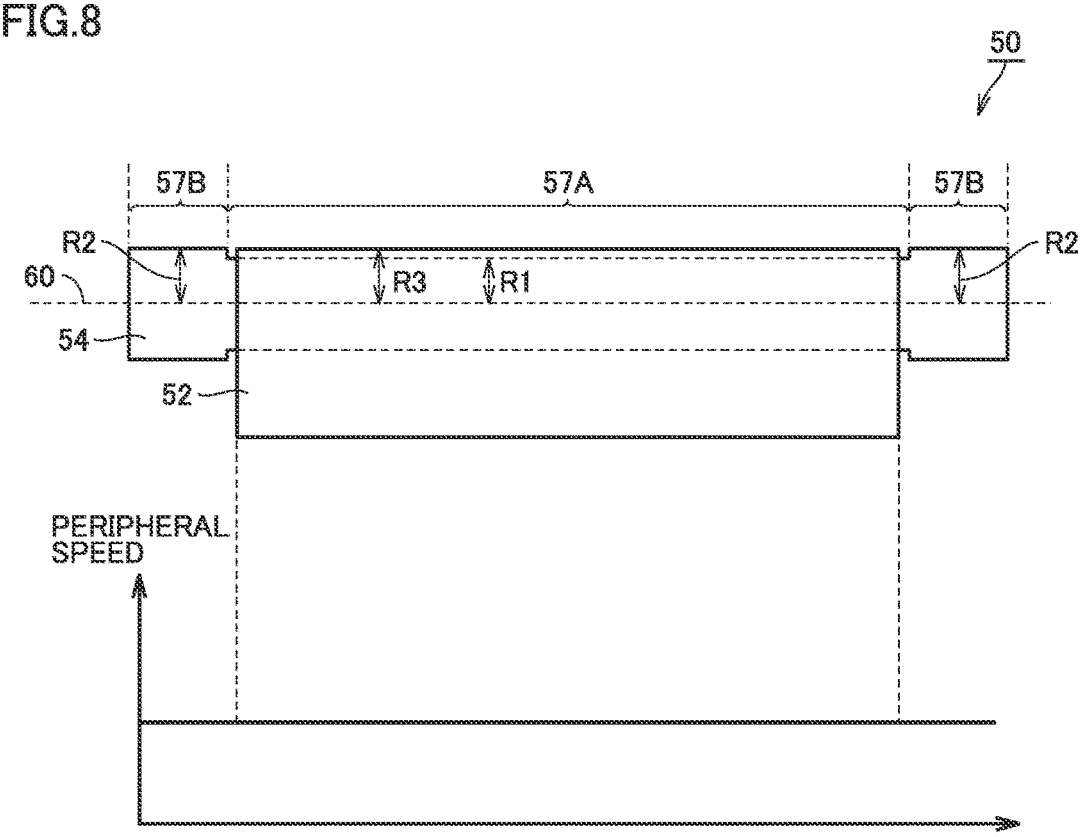
FIG. 8 is a diagram showing an endless belt and a drive roller in the fixation apparatus according to a second modification.

Fixation apparatus 50 according to a second modification as compared with a fixation apparatus 50X4 according to a fourth comparative example will be described with reference to FIGS. 7 and 8. FIG. 7 is a diagram showing endless belt 52 and drive roller 54 in fixation apparatus 50X4 according to the fourth comparative example. FIG. 8 is a diagram showing endless belt 52 and drive roller 54 in fixation apparatus 50 according to the second modification.

As shown in FIG. 7, in fixation apparatus 50X4 according to the fourth comparative example, a diameter of drive roller 54 is constant regardless of a position in axial direction 60. A diameter R1 of drive roller 54 in a portion of contact 57A between drive roller 54 and endless belt 52 is equal to a diameter R2 of drive roller 54 in a non-contact portion 57B between drive roller 54 and endless belt 52. When endless belt 52 is laid over drive roller 54, however, diameter R2 increases to a diameter R3 by a thickness of endless belt 52 in portion of contact 57A. When diameter R1 and diameter R3 are different from each other, a peripheral speed is different between portion of contact 57A and non-contact portion 57B. When a difference in peripheral speed is caused between portion of contact 57A and non-contact portion 57B, drive roller 54 cannot evenly transmit driving force to endless belt 51 and transportation of paper may become unstable.

In contrast, as shown in FIG. 8, in fixation apparatus 50 according to the second modification, diameter R1 of drive roller 54 in portion of contact 57A between drive roller 54 and endless belt 52 is smaller than diameter R2 of drive roller 54 in non-contact portion 57B between drive roller 54 and endless belt 52. Thus, when endless belt 52 is laid over drive roller 54, R3 in portion of contact 57A and diameter R2 in non-contact portion 57B are equal to each other so that a peripheral speed is equal between non-contact portion 57B and portion of contact 57A. Therefore, drive roller 54 can evenly transmit driving force from portion of contact 57A and non-contact portion 57B to endless belt 51 and transportation of paper can be stabilized.

Preferably, a difference between diameter R1 and diameter R2 is adapted to a thickness of endless belt 52. While endless belt 52 is laid over drive roller 54, R2 in non-contact portion 57B is preferably equal to diameter R3 in portion of contact 57A.

An extent over which a diameter of drive roller 54 is differed in axial direction 60 is adapted to a width of endless belt 52 in axial direction 60. Here, a component tolerance is preferably taken into account. Thus, fixation apparatus 50 can prevent endless belt 52 from being laid over non-contact portion 57B and an extent over which a peripheral speed of endless belt 52 is different can be minimized.

[Details of Internal Feature of Fixation Apparatus 50]

Details of each feature provided in fixation apparatus 50 will be described with reference again to FIG. 3. As shown in FIG. 3, fixation apparatus 50 includes endless belt 51, endless belt 52, pressurization member 53, drive roller 54, and heater lamp 56.

Endless belts 51 and 52 have an outer diameter, for example, from 10 to 100 mm Endless belts 51 and 52 are formed, for example, from a base layer, an elastic layer, and a release layer. The base layer is composed of polyimide, SUS (stainless steel), or electroformed nickel (Ni). The base layer has a thickness, for example, from 5 to 100 μm. A material highly resistant to heat such as silicone rubber or fluoroelastomer is employed for the elastic layer. The elastic layer has a thickness, for example, from 10 to 300 μm. A feature provided with releasability such as a fluorine tube or a fluorine-based coating is employed for the release layer. The release layer has a thickness, for example, from 5 to 100 μm. The elastic layer does not have to be provided in an endless belt on a side where a toner image does not pass.

Pressurization member 53 is made, for example, of a resin such as polyphenylene sulfide, polyimide, or a liquid crystal polymer, a metal such as aluminum or iron, or ceramics. Pressurization member 53 may be in any shape. Pressurization member 53 may be constituted of two components including a fixing member composed of silicone rubber or fluoroelastomer. A sliding member for lessening friction may be provided between endless belt 51 and pressurization member 53. The sliding member includes glass cloth as a base material and a sliding surface is coated with a heat resistant resin. In order to lessen sliding resistance, a lubricant may be applied between endless belt 51 and pressurization member 53. A lubricant highly resistant to heat such as silicone oil, silicone grease, fluorine oil, or fluorine grease is employed for the lubricant. Instead of pressurization member 53, a driven roller driven by drive roller 54 may be provided. When a driven roller is employed, a member high in friction resistance is employed for a bearing portion of the driven roller.

Drive roller 54 is made of an elastic layer and a core metal. Drive roller 54 has an outer diameter, for example, from 20 to 100 mm. A material highly resistant to heat such as silicone rubber or fluoroelastomer is employed for the elastic layer. The elastic layer has a thickness, for example, from 1 to 20 mm Preferably, a metal such as aluminum or iron is employed for the core metal. The core metal may be in any shape. By way of example, the core metal may be in a shape of a pipe, may be solid, or may have a cross-section in a shape of three-feather fletching. The core metal has a thickness, for example, from 0.1 to 10 mm.

Though a heat source of endless belt 51 is not particularly limited, by way of example, endless belt 51 is heated by heater lamp 56. Various other heating schemes can be adopted. By way of example, a heating roller (not shown) is provided inside endless belt 51, instead of heater lamp 56. Endless belt 51 is wound around the heating roller so that endless belt 51 is heated thereby. A scheme that pressurization member 53 itself serves as a heat generator may be adopted as another heating scheme. A scheme for heating endless belt 51 through induction heating (IH) may be adopted as another heating scheme. A scheme for having endless belt 51 itself generate heat as a resistance heating element may be adopted as another heating scheme. An element to be heated is not limited to endless belt 51, and endless belt 52 may be heated.

[Summary]

As set forth above, fixation apparatus 50 includes endless belts 51 and 52 for transportation of paper. Drive roller 54 is provided inside endless belt 52. At least one end of drive roller 54 protrudes from endless belt 52 in the axial direction of drive roller 54. The protruding portion of drive roller 54 is in contact with endless belt 51 and a non-protruding portion of drive roller 54 is in contact with endless belt 52. Drive roller 54 is in direct contact with both of endless belt 51 and endless belt 52.

Driving force of drive roller 54 is thus directly transmitted not only to endless belt 52 but also to endless belt 51. As driving force is provided directly from one drive roller 54 to endless belts 51 and 52, endless belt 51 and endless belt 52 can be the same or substantially the same in peripheral speed. Consequently, a difference in peripheral speed between endless belts 51 and 52 is suppressed and image misalignment or paper slippage is suppressed.

Though the embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. A fixation apparatus for fixing a toner image transferred to a transfer target medium onto the transfer target medium with heat, the fixation apparatus comprising:

a first belt without end;

a second belt without end which is in contact with an outer circumferential surface of the first belt;

a pressurization member which is provided inside the first belt and pressurizes a portion of contact between the first belt and the second belt toward the second belt;

a drive roller which is provided inside the second belt along the portion of contact and rotationally drives the second belt;

a heating unit which heats at least one of the first belt and the second belt and provides heat to the transfer target medium passing through the portion of contact, the drive roller being in contact with both of the first belt and the second belt;

wherein at least one end of opposing ends of the drive roller protrudes from the second belt in an axial direction of the drive roller, and a protruding portion of the drive roller from the second belt is in contact with the first belt.

2. The fixation apparatus according to claim 1, wherein the protruding portion of the drive roller is in contact with the outer circumferential surface of the first belt, and a non-protruding portion other than the protruding portion of the drive roller is in contact with an inner circumferential surface of the second belt.

3. The fixation apparatus according to claim 1, wherein a width of the drive roller in the axial direction is smaller than a width of the first belt in the axial direction, smaller than a width of the pressurization member in the axial direction, and greater than a width of the second belt in the axial direction.

4. The fixation apparatus according to claim 1, wherein a distance from one end of the second belt in the axial direction to one end of the drive roller in the axial direction is equal to a distance from the other end of the second belt to the other end of the drive roller, a distance from one end of the pressurization member in the axial direction to one end of the drive roller in the axial direction is equal to a distance from the other end of the pressurization member to the other end of the drive roller, and a distance from one end of the first belt in the axial direction to one end of the drive roller in the axial direction is equal to a distance from the other end of the first belt to the other end of the drive roller.

5. The fixation apparatus according to claim 1, wherein a width of the pressurization member in the axial direction is smaller than a width of the first belt in the axial direction, and the pressurization member is arranged inside the first belt so as not to protrude from opposing ends of the first belt in the axial direction.

6. The fixation apparatus according to claim 1, wherein a pressure applied to a portion of contact between the first belt and the drive roller is higher than a pressure applied to the portion of contact between the first belt and the second belt.

7. The fixation apparatus according to claim 1, wherein a diameter of the drive roller in a portion of contact between the drive roller and the second belt is smaller than a diameter of the drive roller in a portion of contact between the drive roller and the first belt.

8. An image formation apparatus for fixing a toner image transferred to a transfer target medium onto the transfer target medium with heat, the image formation apparatus comprising:

a first belt without end;

a second belt without end which is in contact with an outer circumferential surface of the first belt;

a pressurization member which is provided inside the first belt and pressurizes a portion of contact between the first belt and the second belt toward the second belt;

a drive roller which is provided inside the second belt along the portion of contact and rotationally drives the second belt; and a heating unit which heats at least one of the first belt and the second belt and provides heat to the transfer target medium passing through the portion of contact, the drive roller being in contact with both of the first belt and the second belt;

wherein at least one end of opposing ends of the drive roller protrudes from the second belt in an axial direction of the drive roller, and a protruding portion of the drive roller from the second belt is in contact with the first belt.

9. The image formation apparatus according to claim 8, wherein the protruding portion of the drive roller is in contact with the outer circumferential surface of the first belt, and a non-protruding portion other than the protruding portion of the drive roller is in contact with an inner circumferential surface of the second belt.

10. The image formation apparatus according to claim 8, wherein a width of the drive roller in the axial direction is smaller than a width of the first belt in the axial direction, smaller than a width of the pressurization member in the axial direction, and greater than a width of the second belt in the axial direction.

11. The image formation apparatus according to claim 8, wherein a distance from one end of the second belt in the axial direction to one end of the drive roller in the axial direction is equal to a distance from the other end of the second belt to the other end of the drive roller, a distance from one end of the pressurization member in the axial direction to one end of the drive roller in the axial direction is equal to a distance from the other end of the pressurization member to the other end of the drive roller, and a distance from one end of the first belt in the axial direction to one end of the drive roller in the axial direction is equal to a distance from the other end of the first belt to the other end of the drive roller.

12. The image formation apparatus according to claim 8, wherein a width of the pressurization member in the axial direction is smaller than a width of the first belt in the axial direction, and the pressurization member is arranged inside the first belt so as not to protrude from opposing ends of the first belt in the axial direction.

13. The image formation apparatus according to claim 8, wherein a pressure applied to a portion of contact between the first belt and the drive roller is higher than a pressure applied to the portion of contact between the first belt and the second belt.

14. The image formation apparatus according to claim 8, wherein a diameter of the drive roller in a portion of contact between the drive roller and the second belt is smaller than a diameter of the drive roller in a portion of contact between the drive roller and the first belt.

* * * * *